United States Patent [19]

Winston

[11] Patent Number: 4,545,140

[45] Date of Patent: Oct. 8, 1985

[54] GRAPHIC STAGING DEVICE

[76] Inventor: Jeffery M. Winston, 250 Eden's Rd., Anacortes, Wash. 98221

[21] Appl. No.: 582,180

[22] Filed: Feb. 21, 1984

[51] Int. Cl.[4] ..... G09F 3/18

[52] U.S. Cl. ..... 40/10 D; 40/10 R

[58] Field of Search ..... 40/10 B, 10 D, 10 R, 40/594, 584, 5, 615; 428/14, 33

[56] References Cited

U.S. PATENT DOCUMENTS

| | | | |
|---|---|---|---|
| 3,640,666 | 2/1972 | Jope et al. | 264/553 |
| 3,694,947 | 10/1972 | Mukai et al. | 428/14 |
| 3,977,112 | 8/1976 | Breer | 40/10 D |
| 4,196,535 | 4/1980 | Heimo | 40/10 D |
| 4,211,022 | 7/1980 | Lingelakos | 40/156 |
| 4,270,288 | 6/1981 | Sulzer | 40/10 D |
| 4,275,518 | 6/1981 | Martin | 40/10 D |

*Primary Examiner*—Gene Mancene
*Assistant Examiner*—Cary E. Stone
*Attorney, Agent, or Firm*—Hughes, Barnard & Cassidy

[57] ABSTRACT

A graphic staging device for displaying substantially two-dimensional graphics such as a sign or the like of generally planar configuration, preferably in at least a slightly arcuate presentation and for protecting the same from ambient exposure, is comprised of first and second staging member which are nearly identical, having longitudinal asymmetry such that the two may be nested in mechanically interlocked, transversely mirror-imaged face-to-face engagement. There are very slight dimensional variations between the two staging members; in one instance the overall dimensions are identical but thickness differs, in another instance the dimensional variations are on the same order as the thickness of the members or less.

20 Claims, 3 Drawing Figures

GRAPHIC STAGING DEVICE

BACKGROUND OF THE INVENTION

1. Field of the Invention

The present invention relates, generally, to a graphic staging device for displaying a two-dimensional sign or the like and, more especially, to a generally transparent graphic staging device which "sandwiches" a sign (e.g., a bumper sticker) or other graphic work (e.g., a photograph) in order to present the same for display while protecting it from ambient exposure.

2. Description of the Background Art

All manner and variety of graphic staging devices are of course well known. These range from point of sale devices, utilized in retail establishments to present advertising or descriptive displays accompanying wares offered for sale, to more conventional picture frames or the like for displaying photographs or analagous graphic works. Each type of display or staging device is expressly designed with the type of graphic or visual material to be presented borne in mind, limiting the range of adaptability from one use to another. Also, this general class of display item usually includes at least one relatively rigid member to support or otherwise provide a sign or similar sheet-like graphic material with a modest amount of physical integrity. There are other classes of staging members, such as pockets or sleeves used to house documents or photographs which are made from relatively thin films; but in those instances, strict structural integrity is not of paramount concern. In still further cases some provisions may be made for protecting the graphic material from exposure to the elements or other ambient, in which case oftentimes elaborate constructions are required. With the foregoing as general background, a brief review of representative patented structures provides some greater insights.

U.S. Pat. No. 4,270,288 to Sulzer discloses a picture or other flat article disposed between a transparent plate and a clamping member. The edges are flexible and locked to one another for structural cooperation. U.S. Pat. No. 4,144,664 to DeKorte shows a display assembly where there are front and back plates which include flanges meeting each other in a tongue and groove arrangement to yield a weatherproof display device. Breer U.S. Pat. No. 3,977,112 illustrates a display device comprised of a plate-like sheet of rigid polymer having bent edges or lips bearing pressure sensitive adhesive to secure the device to a support member. U.S. Pat. No. 3,694,947 to Mukai et al discloses another arrangement where there are two plates, each having rearwardly and inwardly extending lips which can engage one another in a manner such that the plate is held between the two; all with an eye toward forming a picture frame. Salz U.S. Pat. No. 3,550,299 shows a device having edge flaps which are folded back to retain a transparent front member on a back member. Howell discloses in U.S. Pat. No. 3,449,848 a triangular structure designed to hold display plates to yield a multi-sided, self-supporting display for posters or the like. In a related patent to the same inventor, namely U.S. Pat. No. 3,178,841, another poster holding device is disclosed; here, one that can be flexed to fit into a frame. U.S. Pat. No. 2,659,991 to Strayer shows a grooved clamping member which is designed to hold opposed members together to form a directory card display. Morse U.S. Pat. No. 781,222 discloses a transparent member held by semicircular grooves to constitute a display mount.

The foregoing devices, while undoubtedly suitable for their intended purposes, do not offer a very wide range of user options. Physical integrity is provided at the cost of flexibility. And, even though many of the display devices available are of fairly low cost, they are nonetheless relatively expensive considering cost of manufacture versus realistic retail price. In some instances the cost of production is increased considerably by the complexity of the mold or other fabrication tools needed to make the components which constitute the display. In sum, although the art is a rather crowded one, there remains room for improvements in both the fabrication of graphic staging devices and the adaptability of same to diverse contexts.

SUMMARY OF THE INVENTION

The present invention advantageously provides an improved graphic staging device which is widely adaptable for displaying graphic materials ranging broadly from such items as bumper stickers to photographs. The present graphic staging device is particularly desirable for its ability to be associated with or on different supports; for example, an automobile should it be desired to display a bumper sticker thereon, a kitchen appliance such as a refrigerator should it be desired to display photographs or reminder messages or the like as is relatively common practice in many homes, or a wall for the same or similar purposes. A particular advantage of the present construction is the ease with which the graphic material may be associated with the instant staging device and, at the user's option, removed and replaced with some other desirable graphics, differing significantly therefore from the customary adhesive (and thus relatively permanent) securement of graphics such as bumper stickers. From a manufacturing point of view, the graphic staging device of the present invention is simple to fabricate, maximizing profitability thereof and yet possesses substantial integrity in use. The graphic staging device of the present invention offers the advantages of conceptually similar display items, is aesthetically appealing, and yet may be made and implemented simply, efficiently, and inexpensively.

The foregoing, and other, advantages of the present invention are realized in one aspect thereof by a graphic staging device for displaying substantially two-dimensional graphics such as a sign or the like of generally planar configuration, preferably in at least a slightly arcuate presentation and offering protection for the graphics from ambient exposure, comprising first and second staging members of formed polymeric webs which are mechanically interlocked in generally face-to-face engagement with the graphics sandwiched therebetween. Each of the formed polymeric webs is most preferably of a generally overall rectilinear configuration, thus defining in a conceptual sense a longitudinal dimension along a major axis, a transverse dimension along a minor axis, and a lateral dimension normal to the two aforesaid, measured in terms of sense across the thickness of the web. Each of the webs is of substantially the same shape with dimensional variations between the two webs being less than or of about the same order as their thickness. The staging members have a substantially identical, longitudinally marginal asymmetric configuration and are nested together in mechanically interlocked, transversely mirror-imaged face-to-face engagement, sandwiching the graphics therebetween. The locking function is improved upon while a modest amount of protection from the ambient is achieved by configuring the two members to have at least a slight radius of curvature when in the interlocked position, as measured in the lateral direction. This curvature in the staging members provides good clamping action on the graphics being displayed by the device; a particularly advantageous and hence preferred feature, particularly when the staging device is to be employed out of doors. In such settings, water or other moisture may find its way intermediate the two members constituting the staging device and, therefore, contact or otherwise be absorbed in or adsorbed on the graphics. However, the tight clamping action thoroughly restrains the graphics thus minimizing wrinkling and distortion of even the lowest grade paper stock or graphic printing stock (albeit, waterproof ink is highly recommended). The physical integrity of the graphics is thereby maintained under these severe circumstances. While this slight arcuate form greatly facilitates the most complete clamping action, whereas a flat configuration will not, it should be borne in mind by those skilled in the art that this curved conformation is most preferable but not essential to the attainment of the full range of advantages of the present invention.

In one preferred embodiment, the two webs are of identical dimensions overall, but are of slightly unequal thicknesses in order that one web may "dominate" over the other, forcing the latter to conform spatially to the former when in mechanically interlocked engagement. In another preferred embodiment the two webs have slightly different overall dimensions, but in this case dimensional variation in length and/or width (as measured respectively along the longitudinal and transverse axes) does not exceed the same order of magnitude as the thickness of webs themselves. Considering the related manufacturing techniques, simply with these two thoughts borne in mind respecting the dimensional variations between webs, either of the two embodiments is very easily fabricated. In the first instance the two webs are made in or on the same mold or form, being identical save for the thickness variation which is easily controlled by control of the feed stock. In the second instance the device is made on two separate molds or forms, but where the second form is evolved directly from the first (as a mother image when bearing a formed web) in order to provide very intimate cooperation between the components made on each.

Regardless of the mode of fabrication or the exact dimensional variations built within the instant device, the webs include the noted asymmetry along longitudinal margins. Most preferably, each web includes opposed, longitudinally marginal, inwardly directed flanges at either edge and a returning, outwardly directed fin along one of those edges, these elements comprisings hinge means. The fin/flange provides the asymmetry while further serving as a convenient place for cooperative interengagement with the opposed member. In a highly preferred embodiment the flanges are sharply arcuate, in the nature of semicircular flanges or possess an analgous reentrant geometry so that the mechanical interengagement is quite positive between the two members, in the nature of latching. More specifically, in the most preferred embodiment of an inner and outer staging member, each made from a resilient polymeric film, the pieces flex as the outer member closes over the inner, distorting slightly and then "snapping" together for a strong latching effect and, due to the resiliency and memory of the components insuring a positive interlocking between the same. The present graphic staging device further preferably includes a peripheral bead formed in each of the webs to define a central staging area within which the graphics are centered and restrained during use. The bead also serves a modest sealing feature to prevent direct exposure to the elements when the device is used out of doors.

The present graphic staging device may be associated with any number of suitable supports, such as an automobile body or bumper, a wall of a building, and interiorly or exteriorly thereof; or indeed any surface, horizontal or vertical. A suitable adhesive borne upon the fin members of each web may facilitate that objective. Alternatively, a magnetic strip may be preferred in lieu of a gum adhesive in situations where the installation is temporary or the user desires to have a staging device with some portability.

Still other advantages of the present invention, and a fuller appreciation of its construction and method of fabrication, will be gained upon an examination of the following detailed description, taken in conjunction with the figures of drawing, wherein:

DETAILED DESCRIPTION OF THE INVENTION

Figure 1:
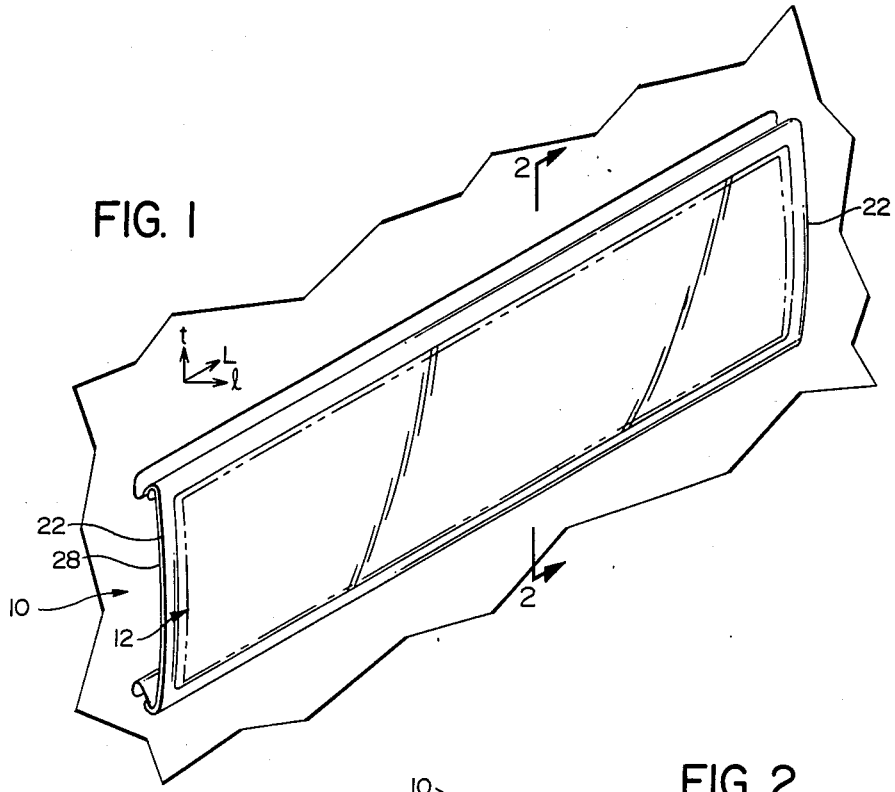
FIG. 1 is an isometric view of a graphic staging device in accordance with the present invention.

The present invention relates, generally, to a graphic staging device for displaying a two-dimensional sign or the like and, more especially, to a generally transparent graphic staging device which "sandwiches" a sign (e.g., a "bumper sticker") or other graphic work (e.g., a photograph) in order to present the same for display while protecting it against ambient exposure. Accordingly, the invention will now be described with reference to certain preferred embodiments within the aforementioned contexts; albeit, those skilled in the art will appreciate that such a description is meant to be exemplary only and should not be deemed limitative.

Turning to the figures of drawing, in each of which like parts are identified with like reference numerals, a graphic staging device in accordance with the present invention, designated generally as 10, is shown to be presenting a graphic work shown in phantom lines and designated generally as 12. The graphic work 12 is sandwiched or captured intermediate a first or outer staging element 14 and a second or inner staging element 16 cooperating therewith. Each of the staging elements or members 14 and 16 is shown to be of a generally rectilinear configuration, although this conformation is selected principally because the vast majority of graphic works anticipated for association with the present device are of similar rectilinear form. Thus, this is not a hard and fast requirement of the invention, but merely one of expediency in terms of description. Regardless of that consideration, the outer staging member 14 is comprised of a central, generally planar web 18 having opposed longitudinal edges identified generally as 20 and transverse edges identified as 22. In a similar vein, the inner member is comprised of a central web 24 having opposed longitudinal edges 26 and transverse edges 28. For purposes of continuing description, the longitudinal and transverse edges will be considered to lie along or otherwise define respective longitudinal and transverse axes, while a lateral axis normal to the approximately common plane in the "thickness" direction can thereby be defined for that same purpose.

Each of the staging members 14 and 16 is most preferably formed with a raised peripheral bead; a bead 30 being included in the periphery of the outer staging member 14 and a bead 32 in the inner staging member 16. The two beads cooperate, as best viewed in FIGS. 1 and 2 in a generally nested manner, to center the graphics 12 and restrain the same firmly within the device 10. These cooperative beads also give a measure of isolation for the graphic from the ambient when, for example, the device 10 is employed out of doors.

The two staging members 14 and 16 have substantially identical, longitudinally marginal asymmetric configurations. More specifically, and as best envisioned with reference to FIG. 3, the two members are asymmetric in transverse section, the asymmetry residing along a longitudinal edge of the member (either 14 or 16). As is also evident, the two members are shaped nearly identically—a consideration explored more fully below—but are disposed in cooperative, nested, mechanically interlocked, transversely mirror-imaged face-to-face engagement as best viewed in FIG. 2. This presents the asymmetrical aspects of each member at opposed longitudinal edges defined by the overall assembly constituting the staging device 10 to facilitate the locking or latching engagement of the two members to yield the staging device.

In the preferred embodiment illustrated in the figures of drawing, the peripheral beads 20 and 26 are shown to be identical; and, in this case, are arcuate or generally semicircular in configuration defining a type of flange. More specifically, the bead 20 includes a semicircular element 34 which continues with a somewhat linear leg or extension 36; while the bead 26 includes an analogous semicircular element 38 with linear leg 40. While this particular geometry (circular) is preferred, it is principally for aesthetic reasons and any type of reentrant element might be adapted to the same end. Regardless, the two interengage in a nested manner, snapping one member positively with the other as best envisioned in with reference to FIG. 2. Thus, across each member up to that point of the terminal legs (36 and 40), the two members are geometrically symmetrical. However, each member includes an outwardly directed return leg from the flange-like configuration provided by the peripheral beads. In the case of the preferred embodiment shown, these are in the nature of fins; an outwardly directed fin member designated generally as 42 being formed along one longitudinal edge of the staging member 14 while a fin 44 is likewise included along a longitudinal edge of the inner staging member 16. These fins which, in the illustrated embodiment, include a first arcuate or return leg, 46 and 48 respectively, terminate in a linear member, 50 and 52 respectively. The arcuate elements 46 and 48 give some deformable resiliency to the assembled staging device 10 in addition to the inherent resiliency of the material from which the same is made, and also function as hinge means as one can best visualize from FIG. 3. Most preferably, the return legs 50 and 52 are provided with a suitable adhesive in order that the staging device may be secured firmly to a support (not shown) as desired by the user. In some instances the staging device will desirably be placed on an automobile in order to display a conventional bumper sticker, in other cases it may be more desirable to place the device on a refrigerator within a home in order to collect the various papers, photographs, and sundry similar items families these days attach to such places by means of magnets, adhesive tape, or other expedient elements. Other uses will occur to those skilled in the art, among which may be mentioned as suggestive include such utilities as the display of programs, labels, notices, schedules, restaurant or theater information, menus, or the like, safety notices, directional notices or information such as entrance signs, exit signs, no smoking signs, fire extinguisher signs, etc. Accordingly, all manner and variety of overall configurations and dimensions are envisioned within the scope of the present invention; these considerations limited solely by the imagination of the designer and the graphics to be displayed.

The two staging members 14 and 16 are most preferably made from transparent or virtually transparent polymeric films. Vinyl polymers, particularly those having ultraviolet resistance, are highly preferred as are films sold under the compositional tradename "Butyrate"; although, those skilled in the art will realize that many other suitable compositions are available. There are two different approaches viewed as preferred in the manufacture of staging devices 10 from such film materials; both involving the most preferred technique of vacuum forming. Each is discussed briefly in turn below.

A preferred manufacturing technique is the vacuum forming of the staging members 14 and 16 on precisely the same form or so-called "plug" which functions as the vacuum mold. Not only does that reduce the number of forms required, since the same design is used to manufacture both parts, it insures virtually identical components comparing one to the other. However, in this situation it is most preferred that one or the other of the two staging members be thinner in order that the thicker of the two may "dominate" in the interengagement or interlocking fit between members. For example, in a highly preferred embodiment the outer staging member 14 will be approximately 0.035" thick while the inner or second member will be approximately 0.020" thick. (Scaling this up or down should pose no difficulty for the skilled artisan should different sizes be desired; thus, these dimensions are recited simply as exemplary.) The two members would normally cooperate as shown in full lines in FIG. 3, with the thicker being the superior member and forcing dominance over the inner element, with some distortion in the latter created. In that case, it is also preferred that the central portion of the web 18 have a matte finish in order to reduce glare, while the central portion 24 of the other member may or may not include such a matte finish as well. Indeed, it may be preferable that the inner element not include a matte finish in order to give the user the option of folding the thicker member (e.g., 14) inwardly and presenting the thinner element (i.e., 16) in the superior position. The thinner section will allow it to distort slightly and adapt itself via inherent flexibility and resiliency to the thicker member giving the user in this instance a clear as opposed to matte or "frosted" finish.

Another manufacturing technique which is preferred under some circumstances employs separate plugs or molds for each of the two staging members. However, in order to insure very precise mating, and thus positive intercooperation between members when the same are assembled into the staging device 10, one of the two plugs is derived directly from the other. More specifically, a first plug or mold is formed in the desired configuration. A film of the desired thickness for one of the staging members is formed on that plug in the normal manner. At this juncture, the staging member borne upon the plug is then utilized to define the contours of the second plug or mold member utilized to form the other staging member to constitute the overall assembly. In that case the second member is a very intimate fit vis-a-vis the mother constituted of the first plug and initially retained first member. Here there are slight variations in the mold or plug sizes yielding slight variations in the two pieces constituting the assembly, thus eliminating the option of folding one or the other of the two members inwardly as suggested in FIG. 3. However, while slightly different, the ultimate difference in dimension is approximately on the same order as the thickness of the films constituting the assembly 10. In some cases, it may be desirable to reduce somewhat that dimensional disparity; although it will usually be less than preferred to eliminate those dimensional variations altogether when employing this manufacturing approach.

Although vacuum forming is the disclosed preference for the fabrication technique of the staging device of the present invention, in general other heat forming and cutting techniques may be employed to produce the device. This may be advantageous where undercuts create obstacles in the vacuum forming or "pressure-on" maufacturing procedures. Also, as those skilled in the art will appreciate, identical mold plugs may be ganged to faciitate the simultaneous manufacture of several pieces per vacuform or pressure-on cycle, thus improving the economics of manufacture.

With the two staging members made, and in accordance with either of the aforementioned techniques or such other as desirable by the fabricator, they are joined together in the nested, intercooperative engagement noted above and shown best in FIG. 2. The device may be packaged and sold in that state, with adhesive borne upon the fins 50 and 52 in order that the user may dispose the staging device at any convenient or desirable location. Installation is as simple as adhering the adhesive fins to, e.g., the door of a refrigerator. The reentrant geometry of opposed flanges maintains the proper alignment and orientation of the two members during that procedure to insure later efficient operation of the device. Once installed, the user need merely depress the webs centrally of the outer one allowing the same to collapse inwardly somewhat and distort along the longitudinal edges. In turn, that releases or otherwise facilitates the release of the two reentrant flange components in order to separate the two staging members as shown in full lines in FIG. 3. A graphic work, such as a sticker, sign, photograph (or series thereof) may then be disposed within the central region defined by the peripheral bead. The device may then simply be snapped back together to yield the configuration of FIGS. 1 and 2.

Figure 2:
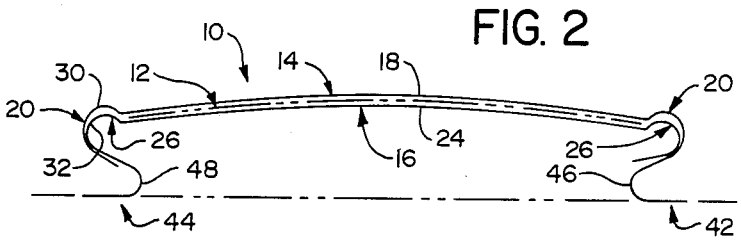
FIG. 2 is a transverse sectional view, taken substantially along the line 2—2 of FIG. 1; and, FIG. 3 is a sectional view, similar to FIG. 2, but here showing the manner in which the two staging members cooperate one with another, with one orientation shown in full lines and an opposed orientation shown in phantom lines.
Figure 3:
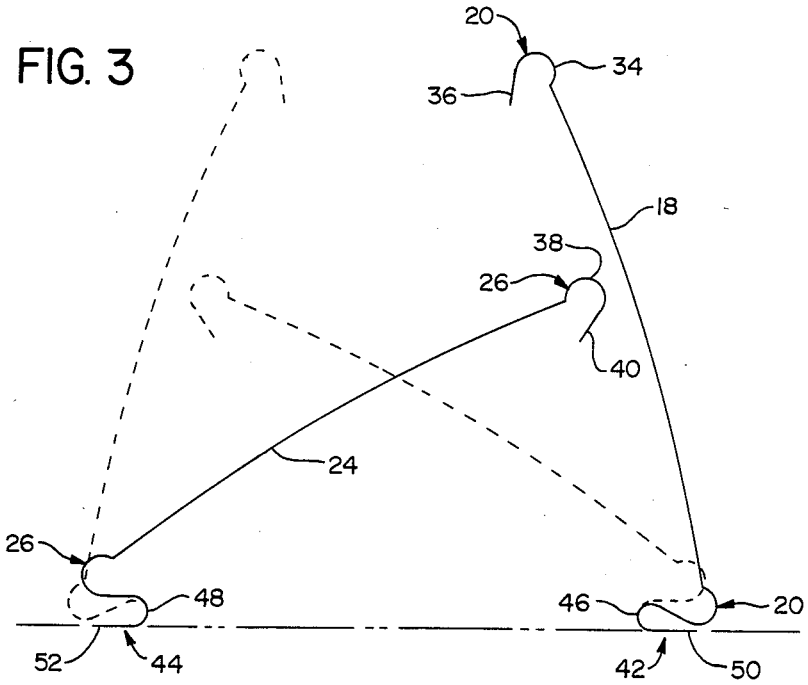

As is evident from the figures of drawing, the graphic staging device 10 has a slight radius of curvature in the transverse profile, as best seen for example in FIG. 2. This results in a slight outwardly directed force, resisted by the reentrant flange members and thus providing a very positive interlock. The curvature may be slight or considerably greater, especially depending upon the environment for which the device is intended. Apart from force tailoring, it might be more desirable to have a somewhat greater radius of curvature where it is expressly intended to use the graphic staging device 10 on an automobile bumper and one must anticipate the presence of bolts of other members protruding therefrom. On the other hand, when utilizing the graphic staging device 10 as a display member on a flat wall or the like a very minimal radius of curvature is sufficient.

While the invention has now been described with reference to certain preferred embodiments, those skilled in the art will appreciate that various substitutions, changes, omissions and modifications may be made without departing from the spirit thereof. For example, the graphic staging device of the present invention is noted to be desirable for displaying such items as bumper stickers on an automobile, the display of photographs or personal messages on a home appliance, wall or the like; and including further the staging of schedules or similar information, direction markers, room assignment labels, locker labelling, safety notices, etc. Consequently, the shape and dimensions of the staging device of the present invention may vary widely, as might the thickness of the staging members themselves, to suit the particular use or adaptation to which the invention is put. Further along these lines, the graphic staging device is usually or may easily be comprised of members which are transparent, semi-transparent, translucent, or which employ films having a desirable color; all with an eye toward, for example, back lighting the device for a functional purpose (e.g., adapting the same to functions as a sign such as an "exit" sign in a retail establishment) or for a desirable aesthetic purpose. Accordingly, it is intended that the foregoing description be viewed merely as exemplary and not be deemed limitative of the scope of the claims granted herein.

What is claimed is:

1. A graphic staging device for displaying substantially two-dimensional graphics of generally planar configuration in at least a slightly arcuate presentation and for protecting the same from ambient exposure, comprising first and second staging members of formed polymeric webs each having substantially the same configuration, said webs being of generally rectilinear form and including a central, slightly arcuate field within a panel surrounded by a raised peripheral bead merging along longitudinal edges to inwardly directed flange members having a reentrant cross section with one of said flange members further including a return leg as a continuous extension thereof to yield a fin bearing adhesive for securing said member to a support, said flange and fin comprising hinge means for said staging member; said graphic staging device being deployed with said staging members disposed in transversely mirror-imaged interengagement with said flanges in cooperative association constituting latching means therefor.

2. A graphic staging device for displaying substantially two-dimensional graphics of generally planar configuration in at least a slightly arcuate presentation and for protecting the same from ambient exposure, comprising first and second staging members of formed polymeric webs, each of said staging members having substantially the same geometric shape and size with any dimensional variations between said webs being in thickness dimensions thereof, and wherein said staging members have substantially identical longitudinally marginal asymmetric configurations for nested, mechanically interlocked engagement in a transversely mirror-imaged disposition, said webs being generally rectilinear webs, said rectilinear webs including a planar, slightly arcuate central panel merging along longitudinal edges to flange members having inwardly directly reentrant elements, one of said flange members including an outwardly directed fin as a reversed, continuous extension thereof.

3. The graphic staging device of claim 2, wherein said central panel is bounded by a raised peripheral bead.

4. The graphic staging device of claim 3, wherein an asymmetric aspect of each of said staging members consists essentially of said fin.

5. The graphic staging device of claim 4, wherein said fin includes a coating of adhesive for securing said device to a support therefor.

6. The graphic staging device of claim 5, secured to a support member with said fins disposed in spaced, generally parallel relationship thereon and with said staging members hingedly disposed therefrom along a first of said flanges, the second flange of the outer of said staging members being disposed over the second flange of the other staging members with the same received interiorly of said reentrant element.

7. The graphic staging device of claim 6, wherein said first staging member is thicker than said second staging member and is formed with a matte finish.

8. A graphic staging device for displaying substantially two-dimensional graphics of generally planar configuration, said device having a longitudinal axis and a transverse axis, said device comprising:

a. first and second generally planar staging elements having generally similar geometric configurations, said first staging element being shaped and arranged to fit over said second staging element so as to be able to enclose a graphic article between the first and second staging elements;

b. said first and second staging elements each having first and second longitudinally extending edge portions positioned on opposite sides of the related staging element, c. said first and second edge portions of the first staging element being arranged to fit over the first and second edge portions, respectively, of the second staging element in gripping relationship so as to releasably secure said first staging element over said second staging element;

d. the first edge portion of the first staging element having a first transversely extending leg portion adapted to be attached to an underlying support member;

e. the second edge portion of the second staging element having a second transversely extending leg portion adapted to be attached to said underlying support member;

f. the first staging element being outwardly movable from said second staging element about said first leg portion as a hinge;

whereby said first staging element can be moved away from said second staging element about said first leg portion, a graphic article can then be placed between said first and second staging elements, and said first staging element can be moved over said second staging element, with the first and second edge portions of the first and second staging elements coming into gripping relationship to contain and display said graphic article.

9. The device as recited in claim 8, said second staging element being movable outwardly about said second leg portion as a hinge.

10. The device as recited in claim 9, wherein at least one of said leg portions extends transversely outwardly from said staging device.

11. The device as recited in claim 10, wherein both of said first and second leg portions extend oppositely from one another transversely outwardly from said graphic staging device.

12. The device as recited in claim 8, wherein at least one of said leg portions extends transversely outwardly from said staging device.

13. The device as recited in claim 12, wherein both of said first and second leg portions extend oppositely from one another transversely outwardly from said graphic staging device.

14. The device as recited in claim 8, wherein the first and second edge portions of the first and second staging elements each have in transverse section a generally curved configuration, whereby the first and second edge portions of the second staging element form convexly curved outer surfaces which fit into, respectively, recesses defined by the first and second edge portions of the first staging element.

15. The device as recited in claim 8, wherein the first and second edge portions of the first and second staging elements have substantially identically asymmetric configurations for nested, mechanically interlocking engagement in a transversely mirrored image disposition.

16. The device as recited in claim 15, wherein said first and second staging elements are generally rectilinear.

17. The device as recited in claim 8, wherein said first and second staging elements are of substantially identical dimensions and are of unequal thicknesses.

18. The device as recited in claim 8, wherein said first and second staging elements each include a planar, slightly arcuate central panel portion.

19. The device as recited in claim 18, wherein at least one of said central panel portions is bounded by a raised peripheral bead.

20. The device as recited in claim 8, wherein said first staging element has a thickness greater than said second staging element, with the first staging element having greater stiffness, so that said first staging element is able to dominate said second staging element when the first staging element is engaged with the second staging element.

* * * * *